US008740416B2

(12) United States Patent
Choi

(10) Patent No.: US 8,740,416 B2
(45) Date of Patent: Jun. 3, 2014

(54) COOLING DEVICE AND LED LIGHTING APPARATUS USING THE SAME

(75) Inventor: Yu Jin Choi, Suwon-si (KR)

(73) Assignee: Saebit Tech Inc., Gwangmyeong-si, Gyeonggi-do (KR)

( * ) Notice: Subject to any disclaimer, the term of this patent is extended or adjusted under 35 U.S.C. 154(b) by 0 days.

(21) Appl. No.: 13/885,244

(22) PCT Filed: Oct. 6, 2011

(86) PCT No.: PCT/KR2011/007390
§ 371 (c)(1),
(2), (4) Date: May 14, 2013

(87) PCT Pub. No.: WO2012/067347
PCT Pub. Date: May 24, 2012

(65) Prior Publication Data

US 2013/0229806 A1 Sep. 5, 2013

(30) Foreign Application Priority Data

Nov. 15, 2010 (KR) ..... 10-2010-0113439

(51) Int. Cl.
*F21V 29/00* (2006.01)

(52) U.S. Cl.
CPC ..... *F21V 29/248* (2013.01); *F21V 29/006* (2013.01); *F21V 29/2206* (2013.01); *F21V 29/30* (2013.01); *Y10S 362/80* (2013.01)
USPC ..... 362/294; 362/249.02; 362/800

(58) Field of Classification Search
CPC ..... F21V 29/00; F21V 29/002; F21V 29/006; F21V 29/22; F21V 29/2206; F21V 29/2293; F21V 29/24; F21V 29/248; F21V 29/30
USPC ..... 362/249.02, 294, 800
See application file for complete search history.

(56) References Cited

U.S. PATENT DOCUMENTS

| | | | |
|---|---|---|---|
| 2009/0040759 | A1 | 2/2009 | Zhang et al. |
| 2009/0046464 | A1 | 2/2009 | Liu et al. |

FOREIGN PATENT DOCUMENTS

| | | | |
|---|---|---|---|
| JP | 2000-121265 | A | 4/2000 |
| JP | 2004-085108 | A | 3/2004 |
| JP | 2008-047383 | A | 2/2008 |
| JP | 2008-051389 | A | 3/2008 |
| JP | 2010-251114 | | 11/2010 |
| KR | 10-0698009 | | 3/2007 |

OTHER PUBLICATIONS

International Search Report issued in PCT Application No. PCT/KR2011/007390 dated Apr. 19, 2012.

*Primary Examiner* — Jason Moon Han
(74) *Attorney, Agent, or Firm* — Revolution IP, PLLC

(57) ABSTRACT

A cooling device for an LED lighting apparatus is disclosed to emit heat generated from the LED lighting apparatus using an LED. The cooling device for a light emitting diode (LED) lighting apparatus to emit heat generated from the LED lighting apparatus that uses an LED includes a heat pipe comprising an end coupled to the LED lighting apparatus, the heat pipe comprising working fluid mixed with a medium and powder having an infrared ray emission property, and a radiation fin provided at the other end of the heat pipe. An LED lighting apparatus includes the cooling device, a mounting plate mechanically coupled to the cooling device for the LED lighting apparatus, the mounting plate formed of a metal material, an LED substrate mounted to the mounting plate, the LED substrate comprising at least one LED arranged thereon, and an LED driving circuit configured to drive the LED. The LED lighting apparatus may be applicable to an interior or exterior light requiring a high luminous intensity such as a streetlight, a fishing light and a flood light.

18 Claims, 2 Drawing Sheets

COOLING DEVICE AND LED LIGHTING APPARATUS USING THE SAME

TECHNICAL FIELD

The present invention relates to a lighting apparatus using a light emitting diode (LED), more particularly, to a cooling device for an LED lighting apparatus to cool heat generated from a lighting apparatus having a high-output, especially, 1 W or more output LED package mounted thereon, and the lighting apparatus using the cooling device.

BACKGROUND ART

Light emitting diode, namely, LED technology has been receiving huge attention as eco-friendly technology. White LED technology has been growing annually approximately by 50% over the world. With the development of LED technology, the prospects of LEDs taking the place of fluorescent lights and other lighting apparatuses are getting real.

Recently, an LED lighting apparatus shows a tendency of using 1 W or more output LED package, which is higher-output than a plurality of low-output LEDs, to reduce the number of LED mounted therein.

In a bulb type lighting apparatus may be mounted approximately 70 or more light emitting diodes with 0.5 W output. In a straight type lighting apparatus may be mounted approximately 400 or more light emitting diodes with the 0.5 W output as an example of a lighting apparatus using the low-output LED. If the lighting apparatus is fabricated with low-output LEDs mounted therein, there are several advantages in lighting efficiency or functional improvement.

However, to mount a number of low-output light emitting diodes in a lighting apparatus at low cost, manufacturers has to use the LED package manufactured with their own technology and the mounting process has to be performed in existing equipment possessed by the manufacturers. Because of that, most manufacturers incapable of manufacturing the LED packages tend to use high-output LEDs for manufacturing lighting apparatuses to prepare LED packages and to reduce the mounting cost of the LED packages.

When the high-output LED is used for a lighting apparatus, heat emission will be a problem. If the high-output LED is used for a lighting apparatus, a light emitting part is concentrated on and the temperature happens to increase accordingly. In addition, brighter and brighter lighting has bee preferred and the absolute quantity of heat has been increasing.

Especially, outdoor lighting is showing such a trend such as a streetlight and a fishing lamp. If the temperature of the LED increases, a forward voltage of the LED decreases and luminescence efficiency deteriorates with a shortened life span of usage. In case of using a high-output LED that reaches a high temperature status easily, an expensive material having a heat-resisting property has to be used in the LED package and this leads to another cost increasing factor.

To solve the heat emission problem, LED lighting apparatuses that use a metal base substrate have been proposed. However, it cannot be said that even the metal base substrate has a sufficient heat emission property. A ceramic substrate formed by printing silver-paste in an aluminum nitride (AlN) plate with high heat conductivity has bee known as substrate for the high-output LED. However, AlN has a disadvantage of high production cost.

There has been an attempt to enhance heat emission by improving a substrate structure of an LED package. As another attempt, a mechanical structure of an LED chip is improved to enhance the heat emission. However, such methods cost much disadvantageously.

DISCLOSURE OF INVENTION

Technical Problem

To solve the problems, an object of the present invention is to provide a cooling device for an LED lighting apparatus, which can cool a high-output LED lighting apparatus effectively with a relatively low cost.

Another object of the present invention is to provide a high-output LED lighting apparatus using the cooling device.

Technical Solution

To achieve these objects and other advantages and in accordance with the purpose of the invention, as embodied and broadly described herein, a cooling device for a light emitting diode (LED) lighting apparatus to emit heat generated from the LED lighting apparatus that uses an LED includes a heat pipe including an end coupled to the LED lighting apparatus, the heat pipe comprising working fluid mixed with a medium and powder having an infrared ray emission property; and a radiation fin provided at the other end of the heat pipe.

In another aspect of the present invention, an LED lighting apparatus includes the cooling device; a mounting plate mechanically coupled to the cooling device for the LED lighting apparatus, the mounting plate formed of a metal material; an LED substrate mounted to the mounting plate, the LED substrate including at least one LED arranged thereon; and an LED driving circuit configured to drive the LED.

The present invention has following advantageous effects. A cooling device for an LED lighting apparatus, which can cool a high-output LED lighting apparatus effectively with a relatively low cost, may be provided.

Furthermore, a high-output LED lighting apparatus using the cooling device may be provided with excellent heat emission efficiency.

BEST MODE

As follows, embodiments of the present invention will be described in detail in reference to the accompanying drawings.

Figure 1:
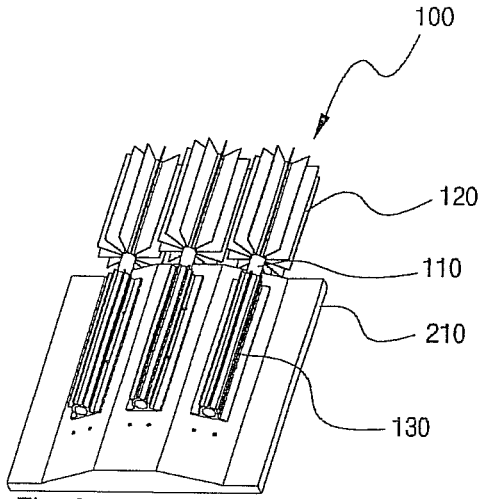
FIG. 1 is a rear view illustrating a cooling device for an LED lighting apparatus according to the present invention that is fixed to a mounting plate provided in the LED lighting apparatus.
Figure 2:
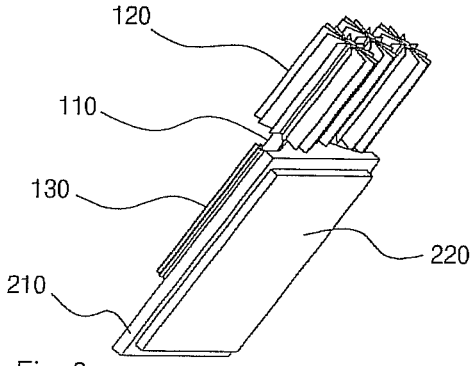
FIG. 2 is a front view illustrating the cooling device according to the present invention fixed to the mounting plate provided in the LED lighting apparatus.

As shown in FIGS. 1 and 2, a cooling device 100 for an LED lighting apparatus according to the present invention may be coupled to a mounting plate 210 provided in an LED lighting apparatus.

According to the present invention, the cooling device 100 for the LED lighting apparatus may include a heat pipe 110, a radiation fin 120 and a coupling member 130.

The heat pipe 110 may include an end mechanically coupled to the mounting plate 210 integrally formed with the LED lighting apparatus. The heat pipe 110 may be pipe-shaped and it may be formed of stainless steel.

The heat pipe 110 is typically formed of a metal material with high heat conductivity such as copper. The copper costs more than steel disadvantageously. As a result, this embodiment represents that the heat pipe is formed of stainless steel. To compensate the deteriorating heat transmissivity of the stainless steel, compared with heat transmissivity of the copper, a different material may be used as working fluid which will be described later, from a material used in a conventional heat pipe as working fluid.

The radiation fin 120 may be arranged in the other end of the heat pipe 110 and it may be formed of a proper material with high heat transmissivity such as aluminum. The heat pipe 110 may be expanded and it may be pressed together with the radiation fin 120, to couple the heat pipe 110 and the radiation fin 120 to each other. In this case, the heat transmissivity from the heat pipe 110 to the radiation fin 120 may be increased and an internal space of the heat pipe 110 may be increased advantageously.

The heat pipe 110 may be coupled to the LED lighting apparatus mechanically as mentioned above. According to the embodiment, the heat pipe 110 may be coupled to the mounting plate 210 composing the LED lighting apparatus by coupling means such as a bolt by means of the coupling member 130 including a first cooling fin.

Like the radiation fin 120, the heat pipe 110 may be expanded and pressed together with the coupling member 130 to couple the heat pipe 110 and the coupling member 130 to each other.

Working fluid may be provided in the internal space of the heat pipe 110. According to the embodiment, the working fluid may include methyl alcohol and powder having an infrared ray emission property. According to this embodiment, the working fluid may not include water (distilled water).

However, a medium of the working fluid used for the heat pipe according to the present invention may not be limited by the methyl alcohol. A variety of fluids having a lower boiling point than water at room temperature may be used. For example, ammonia, methyl chloroform and water may be usable.

Based on the result of experiments performed by the present applicant, it is identified that the working fluid including the powder with the infrared ray emission property performs active cooling even at lower points of temperature in the heat pipe 110, compared with working fluid including no powder having the infrared ray emission property.

In this embodiment, silicate mineral powder may be used as the powder with the infrared ray emission property. The size of the powder having the infrared ray emission property according to the embodiment may be 15~150 micrometers (100 to 1000 meshes) and it may emit an infrared ray wavelength of 7~20 micrometers.

The heat pipe 110 may have a pipe shape with a circular cross sectional area and the internal space of the heat pipe 110 may be maintained vacuum. A vacuum degree of the internal space may be set based on a target temperature desired to cool. For example, an internal pressure of the heat pipe 110 may be set to be 0.001~0.0001 mmhg.

Here, the methyl alcohol and the powder having the infrared ray emission property that composes the working fluid may occupy the internal space by 10% to 30% and 0.5% to 2% with respect to the volume, respectively.

A passage forming projection may be provided in the heat pipe 110 and the passage forming projection may form a passage to enable gaseous working fluid to return to its original position in a condensed status, after moving to the radiation fin 120. Here, the heat pipe 110 may be inclined upwardly to the radiation fin 120.

Also, a wick may be provided in the heat pipe 110 to enable the working fluid to return to the original position. The work may return the condensed working fluid by using a capillary phenomenon. When the wick is provided, a cooling efficiency of 20% may be maintained advantageously even if an angle at which the heat pipe 110 is mounted is disadvantageous to perform the cooling process.

The heat transmission performed in the heat pipe 110 will be described as follows.

When the LED lighting device generates heat, the heat generated in the LED lighting device may be transmitted to the heat pipe 110 and the medium provided in the heat pipe 110 may starts to vaporize. At the same time, the powder starts to emit an infrared ray.

Hence, the vaporized medium may transmit the heat to the radiation fin 120 while moving toward the radiation fin 120. Here, the heat pipe 110 may be in a vacuum status and the heat transmission process may be performed rapidly.

The gaseous medium that completes the heat emission may be condensed on an internal surface of the heat pipe 110 and the condensed medium may return downwardly.

The heat transmission performed by the powder will be described in detail as follows.

An electromagnetic wave having an infrared ray may transmit heat based on a heat radiation method. Different from a conduction or convection method, heat transmission may be enabled even in a vacuum status. The electromagnetic wave may be classified based on a wavelength. For example, based on the length of a wave, the electromagnetic wave may be classified into an infrared ray, a visible ray and an ultraviolet ray. Typically, a material absorbs an electromagnetic wave having a specific range of wavelengths. As the temperature is getting high, the material emits an electromagnetic wave having a specific range of wavelengths.

The working fluid of the heat pipe 110 may be mixed with a material capable of generating an electromagnetic wave. In this case, the material may generate the electromagnetic wave as the temperature is increasing. The generated electromagnetic wave may transmit heat to the medium occupying the internal space of the heat pipe 110 and the internal wall of the heat pipe 110 according to a radiation method. If powder of the material is a solid that is not ionized, the solid powder is not vaporized and it may be collected in an area where the fluidal medium is vaporized.

As a result, the electromagnetic wave emitted by the material may be mainly absorbed to the fluidal medium and it may not reach the area where the gaseous medium is condensed. Because of that, the evaporation of the medium contained in the working fluid may be getting rapid while the condensation of the gaseous medium is not interfered with.

The heat cycle inside the heat pipe 110 may be rotated rapidly, compared with a heat cycle without the material. To make the heat cycle performed more rapidly, the condensation of the medium has to be performed rapidly. The applicant of the present invention compared the temperature of the radiation fin 120 when the working fluid includes the material capable of generating the electromagnetic wave with the temperature of the radiation fin 120 when the working fluid includes no material capable of generating the electromagnetic wave. The temperature of the radiation fin 120 in the former case is higher, based on the result of experiments performed by the applicant of the present invention.

In the meanwhile, the infrared ray tends to be well absorbable, because it has a similar frequency to a natural frequency of a molecular-stated material. A material that generates an infrared ray when the temperature increases may be one of proper materials provided in the heat pipe 110.

Here, the materials generating the infrared ray when the temperature increases may include the silicate mineral powder used in the embodiment, jade powder, carbon powder and the like. Here, it is preferable that a material capable of emitting an electromagnetic wave with a proper wavelength range to be absorbed to the main medium composing the working fluid may be provided in the heat pipe 110.

It is preferable that the material capable of generating the electromagnetic wave may be powder type when it is provided in the working fluid of the heat pipe 110. When the particle size of the powder is small, energy (heat) required to increase the temperature of the particles may be small and a short time may be taken to increase the temperature that is proper to emit a sufficient quantity of electromagnetic waves.

However, manufacturing costs will increases to make the particle size small commonly and the costs will increase geometrically to make the particle size be a predetermined value or less. If the particle size is large, the manufacturing costs will decrease. However, a relatively large energy (heat) has to be supplied until the sufficient quantity of the electromagnetic waves are generated, only to fail to increase the temperature enough to generate the electromagnetic waves rapidly and to contribute to a cooling effect of the heat pipe 110 accordingly.

As a result, the powder may have a predetermined particle size that can increase the temperature proper to generate a sufficiency amount of electromagnetic waves, even with a small energy and without high manufacturing costs.

As mentioned above, the working fluid of the heat pipe 110 according to the embodiment of the present invention may be methyl alcohol and the material capable of generating electromagnetic waves may be silicate mineral powder. When the temperature is increasing, the silicate mineral powder provided in the heat pipe 110 may emit an infrared ray having a predetermined range of wavelengths and the infrared ray having the predetermined range of wavelengths may activate the evaporation of methyl alcohol. If a different medium is provided, the wavelength range of the absorbing electromagnetic wave may be different. Because of that, different powder has to be provided that can generate an electromagnetic wave with a proper wavelength range to be absorbed by the different medium.

EMBODIMENT

Figure 3:
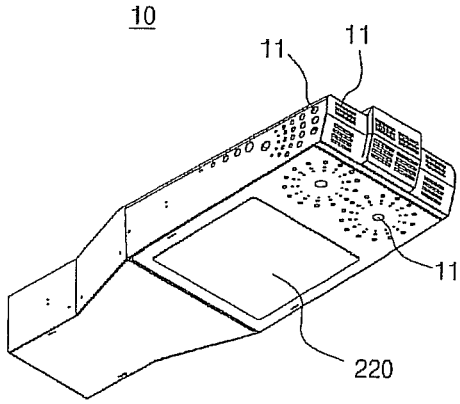
FIG. 3 is a diagram illustrating a streetlight used as an example of the LED lighting apparatus according to the present invention.
Figure 4:
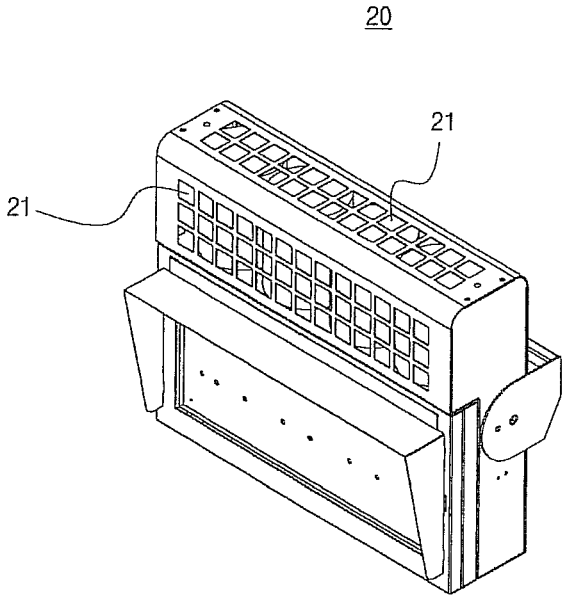
FIG. 4 is a diagram illustrating a fishing light used as another example of the LED lighting apparatus according to the present invention.

FIGS. 3 and 4 illustrate an LED lighting apparatus including the cooling device 100 according to the present invention described above. FIG. 3 illustrates the cooling device applied to a streetlight 10 and FIG. 4 illustrates the cooling device applied to a fishing light 20.

LED lighting apparatuses 10 and 20 shown in FIGS. 3 and 4 may include the cooling device mentioned above. Each of the LED lighting apparatuses 10 and 20 may include a mounting plate 210, an LED substrate 220 and an LED driving circuit (not shown). The mounting plate 210 may be formed of a metal material and the cooling device for the LED lighting apparatus according to the present invention may be mechanically coupled to the mounting plate 210. The LED substrate 220 may be mounted to the mounting plate 210 and at least one LED may be arranged on the LED substrate 220. The LED driving circuit (not shown) may drive the LED arranged on the LED substrate 220.

In this embodiment, the LED may be a high-output LED with 1 W or more output. In case of using the high-output LED, the required luminous intensity may be generated even with a small number of light emitting diodes. Because of that, the weight of the lighting apparatus and the manufacturing costs thereof may be reduced.

In case of using a low-output LED with 1 W or less output, the heat generated from the LED may not be a serious problem and necessity of the cooling device may be reduced. However, a large number of low-output light emitting diodes have to be used to provide the same luminous intensity. Because of that, the price and the weight of the lighting apparatus may be increased.

An interior or exterior LED lighting apparatus such as a streetlight, a fishing light and a flood light may use a high-output white LED with 3 W or more output, a multi-chip LED a multi-chip LED combined with red, green and blue (RGB) single chips with 1 W or more output or a RGB single-chip LED with 1 W or more output based on a purpose of the lighting apparatus. The LED used therein may be changed based on a purpose of the LED. The fishing light may require a blue light, not the white light.

The LED driving circuit may supply voltage currents to the high-output LEDs by 60% or more of the allowable maximum currents. 60% to 70% of the allowable maximum currents may be supplied to the high-output LEDs. If supplied currents are more than that, the luminous intensity generated by the LEDs may increase and the generated heat may increase drastically. Because of that, efficiency might deteriorate and a life of the LED might be shortened.

However, even when 60% or more of the maximum currents, for example, 90% are supplied as driving currents, the cooling device according to the present invention may perform sufficient cooling. Because of that, the LEDs may generate more luminous intensity, with maintaining proper efficiency.

The mounting plate 210 may be mechanically coupled to the cooling device 100 for the LED lighting apparatus. According to the embodiment, the heat pipe 110 of the cooling device 100 may be fixed to the mounting plate 210 by means of the coupling member 130 including the first cooling fin as shown in FIG. 1. The mounting plate 210 may be formed of a material with good heat transmissivity, for example, a metal material such as aluminum.

In case of using the cooling device 100 according to the embodiment, the temperature of the mounting plate 210 may be maintained in a range of 20° C. to 80° C. when the lighting apparatus is put into operation. The efficiency of the high-output LED may be maintained good and the life of the LED may be extended at the range of the temperatures. As mentioned above, the temperature of the high-output LED may be increased when the cooling device 100 according to the present invention is not used. Because of that, the efficiency of the LED may be deteriorated and the life of the LED may be shortened.

The LED lighting apparatus may further include a reflective plate (not shown) to reflect the light emitted from the LED toward a desired lighting direction.

Also, the LED lighting apparatus may further include a housing. The housing may be provided at a position corresponding to the cooling device 100 for the LED lighting apparatus and it may include radiation holes 11 and 21 to emit the heat.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

The present invention relates to a cooling device used for a high-output LED lighting apparatus and an LED lighting apparatus using the same. The LED lighting apparatus including the cooling device may be used as a streetlight for a street, a public office and a school and a fishing light for fishing. As a result, the LED lighting apparatus according to the present invention may be industrially used far and wide.

The invention claimed is:

1. A cooling device for a light emitting diode (LED) lighting apparatus to emit heat generated from the LED lighting apparatus using an LED: the cooling device comprising:

a heat pipe comprising an end coupled to the LED lighting apparatus, the heat pipe using working fluid which comprises of a medium containing methyl alcohol and powder having an infrared ray emission property mixed with each other; and a radiation fin provided in the other end of the heat pipe, wherein an internal space formed in the heat pipe is vacuum, and the methyl alcohol contained in the working fluid and the powder having the infrared ray emission property occupy the internal space formed in the heat pipe by 15%~30% and 0.5%~2%, respectively.

2. The cooling device for the LED lighting apparatus as claimed in claim 1, wherein the heat pipe comprises no wick.

3. The cooling device for the LED lighting apparatus as claimed in claim 1, wherein the powder having the infrared ray emission property mixed in the working fluid of the heat pipe is silicate mineral powder.

4. The cooling device for the LED lighting apparatus as claimed in claim 3, wherein the particle size of the powder having the infrared ray emission property is 15~150 micrometers.

5. The cooling device for the LED lighting apparatus as claimed in claim 1, wherein infrared rays in a band where infrared rays are absorbed to the medium are emitted when the powder having the infrared ray emission property is heated.

6. The cooling device for the LED lighting apparatus as claimed in claim 1, wherein the working fluid of the heat pie comprises no water.

7. The cooling device for the LED lighting apparatus as claimed in claim 1, wherein the heat pipe is formed of stainless steel, with a pipe shape, and the radiation fin is formed of aluminum, and the heat pipe and the radiation fin are coupled to each other by expanding the heat pipe and pressing the expanded heat pipe and the radiation fin.

8. The cooling device for the LED lighting apparatus as claimed in claim 1, wherein the heat pipe and the LED lighting apparatus are coupled to each other by means of a coupling member comprising a cooling fin.

9. The cooling device for the LED lighting apparatus as claimed in claim 8, wherein the coupling member and the heat pipe are coupled to each other by expanding the heat pipe and pressing the expanded heat pipe together with the coupling member.

10. An LED lighting apparatus comprising:

the cooling device as claimed in claim 1;

a mounting plate to which the cooling device for the LED lighting apparatus is mechanically coupled, the mounting plate formed of a metallic material;

an LED substrate mounted to the mounting plate, the LED substrate comprising at least one LED arranged thereon; and an LED driving circuit configured to drive the LED arranged in the LED substrate.

11. The LED lighting apparatus as claimed in claim 10, wherein the LED is a high-output LED with 1 W or high output.

12. The LED lighting apparatus as claimed in claim 11, wherein the LED driving circuit supplies currents to the LED by 60% or more of the maximum driving currents.

13. The cooling device for the LED lighting apparatus as claimed in claim 11, wherein the LED is a high-output white LED with 3 W or higher output.

14. The LED lighting apparatus as claimed in claim 11, wherein the LED is a multi-chip LED combined with red, green and blue (RGB) single chips with 1 W or more output.

15. The cooling device for the LED lighting apparatus as claimed in claim 10, wherein the mounting plate is mechanically mounted to the cooling device for the LED lighting apparatus by means of a coupling member comprising a cooling fin.

16. The LED lighting apparatus as claimed in claim 10, wherein the temperature of the mounting plate is maintained in a range of 20° C. to 80° C., when the LED is driven.

17. The LED lighting apparatus as claimed in claim 10, further comprising:

a reflective plate configured to reflect the light emitted from the LED toward a desired lighting direction.

18. The LED lighting apparatus as claimed in claim 10, further comprising:

a housing provided at a predetermined position corresponding to the cooling device for the LED lighting apparatus, the housing comprising a radiation hole to emit heat.

* * * * *